United States Patent [19]

Baker

[11] 4,061,961

[45] Dec. 6, 1977

[54] CIRCUIT FOR CONTROLLING THE DUTY CYCLE OF AN ELECTROSTATIC PRECIPITATOR POWER SUPPLY

[75] Inventor: Forester C. Baker, Fort Thomas, Ky.

[73] Assignee: United Air Specialists, Inc., Cincinnati, Ohio

[21] Appl. No.: 702,188

[22] Filed: July 2, 1976

[51] Int. Cl.[2] ..... B03C 3/68; G05F 1/44

[52] U.S. Cl. ..... 323/21; 55/105; 323/4; 323/22 SC; 361/100; 361/111; 361/160

[58] Field of Search ..... 55/105, 139; 307/311; 317/14 C, 50, 52, 124, 125; 323/4, 6, 9, 21, 22 SC, 36, 39; 361/18, 35, 100, 111, 160, 205

[56] References Cited

U.S. PATENT DOCUMENTS

| | | | |
|---|---|---|---|
| 3,165,671 | 1/1965 | Mintz et al. | 317/52 X |
| 3,599,082 | 8/1971 | Besier | 323/21 |
| 3,643,405 | 2/1972 | Vukasovic et al. | 323/9 UX |
| 3,648,437 | 3/1972 | Bridges | 323/9 UX |
| 3,696,288 | 10/1972 | Carman | 323/21 |
| 3,816,763 | 6/1974 | Korn et al. | 323/21 X |
| 3,877,896 | 4/1975 | Muskovac | 55/105 |

*Primary Examiner*—A. D. Pellinen

*Attorney, Agent, or Firm*—Melville, Strasser, Foster & Hoffman

[57] ABSTRACT

A circuit for controlling the duty cycle of a two-stage electrostatic precipitator power supply. The circuit includes a switching device connected in series with the primary winding of the power supply transformer and a circuit operable for controlling the switching device. A capacitive network, adapted to monitor the current in the primary winding of the power supply transformer, is provided for operating the control circuit. Under normal operating conditions, i.e., when the current in the primary winding of the power supply transformer is within normal limits, the capacitive network operates the control circuit to allow current flow through the power supply transformer primary winding in a normal manner. However, upon sensing the increased primary current level associated with a high voltage transient generated by arcing between components of the precipitator and reflected from the secondary winding of the power supply transformer to the primary winding thereof, the capacitive network operates the control circuit for causing the switching device to inhibit current flow through the primary winding substantially until the arcing condition associated with the high voltage transient is suppressed. Following an interval after termination of the high voltage transient, the switching device is automatically caused to re-establish primary winding current flow thereby re-establishing normal operation of the electrostatic precipitator power supply.

2 Claims, 4 Drawing Figures

CIRCUIT FOR CONTROLLING THE DUTY CYCLE OF AN ELECTROSTATIC PRECIPITATOR POWER SUPPLY

BACKGROUND OF THE INVENTION

The circuit of the present invention relates generally to means for controlling the duty cycle of a power supply. More specifically, the circuit of the present invention relates to means for controlling the duty cycle of a two-stage electrostatic precipitator power supply transformer in response to high voltage transients generated by arcing between components of the precipitator and reflected therefrom through the secondary winding of the transformer to the primary winding.

The use of two-stage electrostatic precipitators to remove dry particulates or contaminants from an air stream is well known in the art. Typically, an ionizer is utilized to produce an electrostatic field to charge the contaminating particles. The charges particles are then passed through a collecting cell comprised of charged and grounded plates to accumulate the charged particles or contaminents.

In order to achieve efficient operation of electrostatic precipitators of the type described above it is well known that relatively high voltage levels must be utilized in both the ionizer and collecting cells. As contaminants are accumulated by the precipitator collecting cells, it is not uncommon for intermittent arcing, which may progress to a virtually continuous condition, to occur between the highly charged potential surfaces and ground within the precipitator. Arcing of this type results in the generation of high voltage transient spikes which are fed back from the precipitator to the power supply secondary winding and are therefrom reflected into the transformer primary circuit. And, since the components typically used in power supplies intended for use with electrostatic precipitators are normally not rated to withstand the high voltage transient spikes, continued arcing within the precipitator may significantly shorten the useful service life of the power supply, as well as significantly damaging the precipitator itself.

Prior art means for protecting electrostatic precipitator power supplies generally takes one of three forms. Frequently a fuse or circuit breaker is used in the transformer primary circuit in order to protect the power supply components from destructively high current levels. Also, it is known in the prior art to employ ferroresonant circuits in the transformer secondary to protect against a continuous short circuit condition. Although some of the foregoing devices present somewhat of a nuisance, they generally provide adequate power supply protection for electrostatic precipitators utilized in most residential and commercial applications. However, in industrial applications where higher operating voltages and larger contamination accumulations of varying conductivity result in more frequent arcing between precipitator components, the prior art power supply protection devices do not provide acceptable performance. In other words, although the prior art devices provide protection against conditions such as a complete short circuit, for anything between normal operation and the short circuit, the protection is inadequate. And, significantly, the prior art devices provide virtually no protection in the case of intermittent or continuous arcing between precipitator potential surfaces.

It will be appreciated that any protective device designed to overcome the foregoing limitations in the prior art will most advantageously be located in the power supply primary circuit. This obviates the need for the additional isolation which would be necessary if the device was located in the secondary circuit due to the high voltage levels developed therein.

SUMMARY OF THE INVENTION

In order to overcome the foregoing limitations in the prior art, it is, in general, an object of the present invention to provide in combination with a two-stage electrostatic precipitator power supply improved means for protecting the precipitator and the power supply from high voltage transient spikes generated by arcing between components of the precipitator and reflected from the secondary of the power supply transformer to the transformer primary circuit.

More specifically, it is an object of the present invention to provide a circuit for controlling the duty cycle of an electrostatic precipitator power supply such that transformer primary current is inhibited by the development of an arcing condition between precipitator components and at least until the arcing condition terminates.

In accordance with these and other useful objects, the present invention comprises a switching device connected in series with the primary winding of the precipitator power supply transformer and means for controlling the switching device. A capacitive network, connected for sensing the current developed in the transformer primary winding, allows the switching device to pass primary current so long as the current is within normal limits. However, in response to the development of an arcing condition in the precipitator, as evidenced by the increased current levels in the primary circuit resulting from the reflection of high voltage transients from the transformer secondary circuit, the capacitive network will temporarily inhibit current flow through the primary winding. Primary winding current will be inhibited, cutting off power to the precipitator, at least until the arcing condition has been suppressed and until the capacitive network has had an opportunity to discharge, whereupon normal primary current is resumed.

It will be appreciated that the circuit of the present invention, by cutting off power to the precipitator in response to the development of an arcing condition between precipitator components, significantly facilitates the suppression of the arcing condition thereby protecting both the power supply as well as the precipitator itself from excessive damage. Furthermore, since the circuit automatically resets the switching device to allow primary current flow after the arcing condition has been suppressed, the time consuming and annoying practice of replacing fuses and resetting circuit breakers is avoided.

DESCRIPTION OF THE PREFERRED EMBODIMENTS

Figure 1:
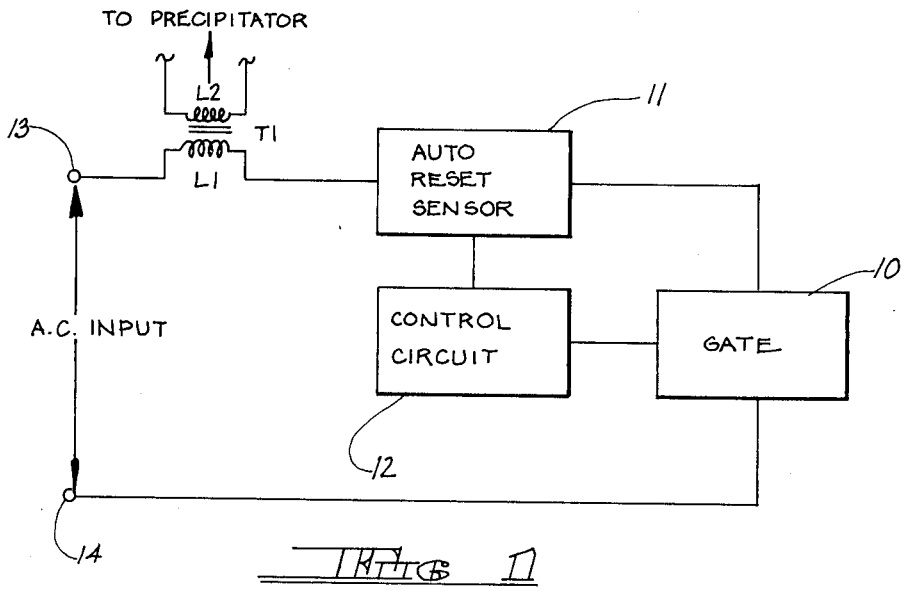
FIG. 1 is a generalized block diagram showing the essential functional components of the circuit of the present invention.

Turning now to the drawings, and particularly to FIG. 1, the essential functional elements of the circuit of the present invention include a switching device or gate 10, an automatically resettable sensor 11, and a control circuit 12. Gate 10, which is connected in series with the primary winding L1 of a two-stage electrostatic precipitator power supply transformer T1, is operable by control circuit 12 for either allowing or inhibiting current flow through primary winding L1. In turn, control circuit 12 is responsive to sensor 11, the latter being adapted to monitor the current developed through primary winding L1.

Under normal operating conditions, the current flowing through primary winding L1 and sensed by sensor 11 will be attributable primarily to the A.C. input voltage applied to terminals 13 and 14. It will be appreciated that, by conventional transformer action, a voltage will thereby be induced across secondary winding L2 of transformer T1 and applied through appropriate filtering and processing circuits as a D.C. voltage to the electrostatic precipitator. As long as normal operating conditions exist, sensor 11 will allow control circuit 12 to maintain gate 10 closed so that current flow through the primary winding L1 is not affected. However, in response to the development of an arcing condition in the precipitator, which sensor 11 detects in the form of increased current through primary winding L1 resulting from the reflection of high level transients from secondary winding L2, control circuit 12 is caused to open gate 10 to inhibit current flow through the primary winding L1. Consequently, secondary winding L2 is de-energized, removing power from the precipitator and causing suppression of the developed arcing condition. Following a short interval after the suppression of the arcing condition, sensor 11 is automatically reset, allowing control circuit 12 to close gate 10 and thereby reestablish normal current flow through primary winding L1 and the concomittant energization of the electrostatic precipitator.

It will be appreciated that in accordance with the foregoing functional description, the duty cycle of the electrostatic precipitator power supply is modified by temporarily interrupting current flow through the primary winding L1 of transformer T1 in response to the development of an arcing condition in the precipitator. The temporary interruption briefly deenergizes the precipitator in order to suppress the arcing condition before any damage results to either the precipitator itself or to power supply components. After the arcing condition has been suppressed, normal power supply operation is restored and the precipitator is allowed to function normally. In addition to the hardware protection achieved, it will be appreciated that the time consuming and annoying practice of replacing fuses and resetting circuit breakers blown by intermittent arcing in the precipitator is completely eliminated.

Figure 2:
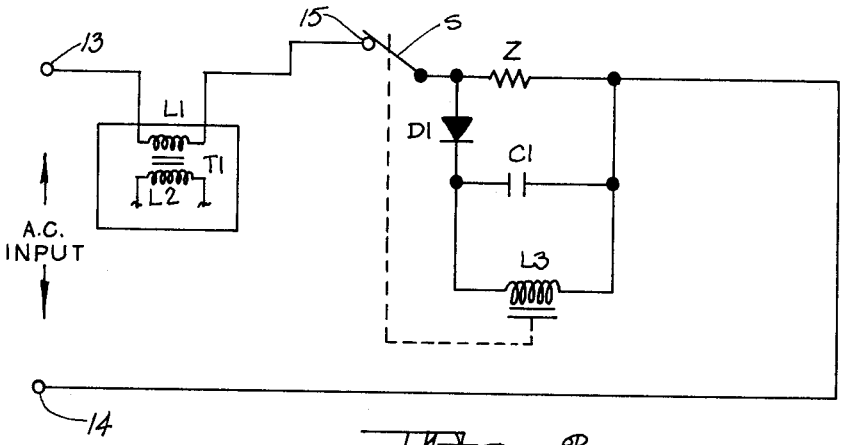
FIG. 2 is a schematic diagram showing an electromechanical embodiment of the circuit of the present invention.

An electromechanical embodiment of the present invention implementing the functional description provided above is shown in FIG. 2. The pole S of a normally closed sensitive D.C. relay is connected in series with the primary winding L1 of transformer T1 and with an impedance Z. The anode of diode D1 connects to the junction between pole S and impendance Z, the cathode of diode D1 connecting to one plate of capacitor C1. The other plate of capacitor C1 is connected to the remaining end of impedance Z. Finally, the energizing winding L3 of the D.C. relay is connected in parallel with capacitor C1.

Under normal operating conditions, pole S of the D.C. relay engages contact 15 as shown in FIG. 2 to allow current flow through the primary winding L1. Component values are chosen so that primary current will charge capacitor C1 through diode D1 to a D.C. level below that required to cause energizing winding L3 to operate pole S. Therefore, under normal operating conditions, pole S will remain closed whereby primary current flow will induce a voltage in secondary winding L2 of transformer T1 which, after being appropriately filtered and processed, is applied for operating the electrostatic precipitator.

Upon the development of an arcing condition in the precipitator, high level transients will be reflected from the secondary winding L2 to the primary winding L1 of transformer T1. The high level transients will cause an increased current to flow through primary winding L1 which will cause capacitor C1 to charge through diode D1 to a correspondingly increased level. The increased charge capacitor C1 will then cause energizing winding L3 to operate pole S to open the primary circuit, thereby de-energizing the precipitator to facilitate suppression of the arcing condition.

With pole S open, i.e., not engaging contact 15, capacitor C1 immediately begins discharging through energizing winding L3. In this regard, it will be noted that diode D1 is connected to limit the discharge path of capacitor C1 to energizing winding L3 only. After capacitor C1 has discharged to a level corresponding to the drop-out level of the D.C. relay, energizing winding L3 will allow pole S to remake the primary circuit thereby reapplying power to the electrostatic precipitator. Thus, in response to the development of an arcing condition in the precipitator, the circuitry of FIG. 2 substantially immediately removes power from the precipitator to suppress the arcing condition. Thereafter, and after capacitor C1 has discharged to an appropriate level, normal operation of the precipitator is automatically re-established.

Figure 4:
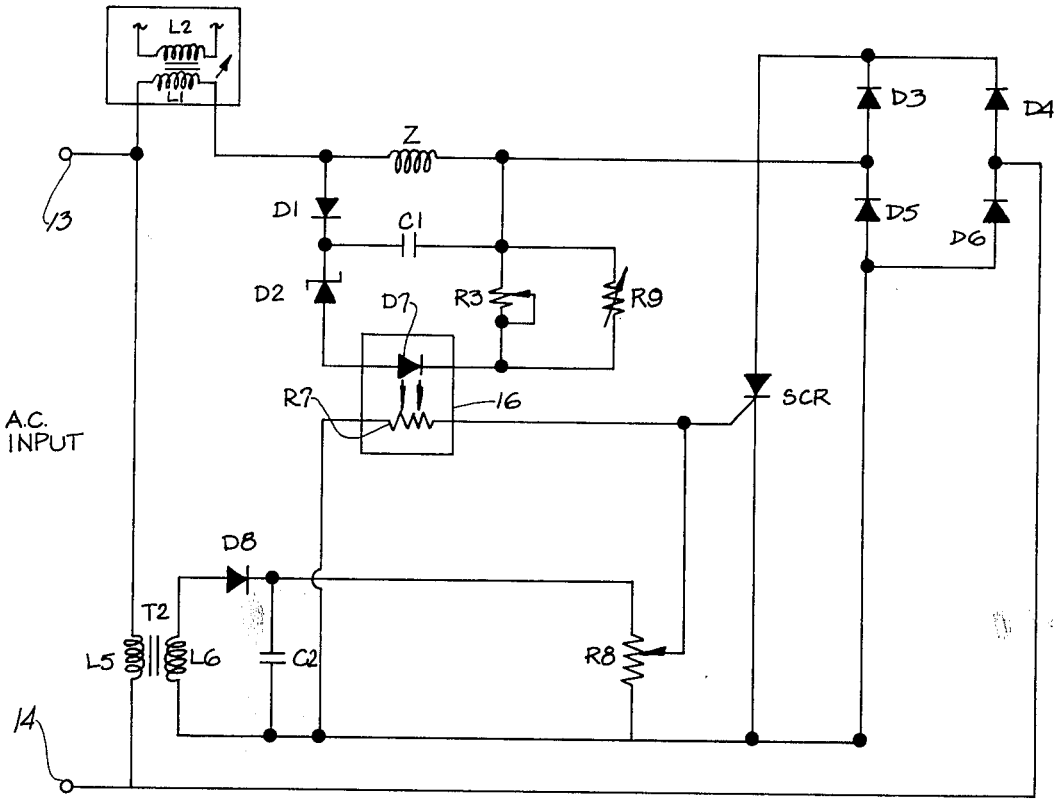
FIG. 4 is a schematic diagram showing another solid state embodiment of the circuit of the present invention.
Figure 3:
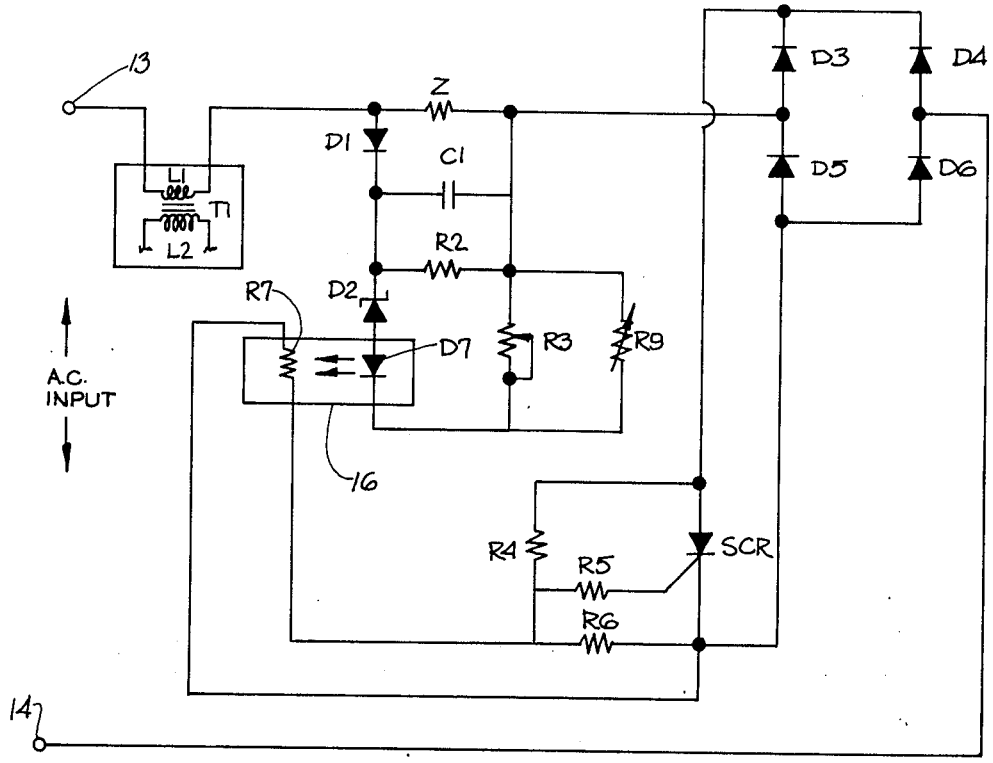
FIG. 3 is a schematic diagram showing a solid state embodiment of the circuit of the present invention.

Related solid state embodiments of the present invention are shown in FIGS. 3 and 4. With particular reference to FIG. 3, an SCR is connected in series with the primary winding L1 of transformer T1 and with impedance Z. A bridge rectifier comprising diodes D3, D4, D5 and D6 is connected between the anode and the cathode of the SCR. The SCR gate voltage is derived from the pulsating D.C. voltage developed across the bridge rectifier by means of the voltage divider comprising resistors R4 and R6 and applied to the SCR gate electrode through resistor R5.

A capacitive voltage sensing network comprising diode D1 and capacitor C1 is connected across impedance Z as previously described with respect to the FIG. 2 embodiment. The junction formed between one plate of capacitor C1 and the cathode of diode D1 is connected to the cathode of zener diode D2. The anode of zener diode D2 connected through LED (light emitting diode) D7 of optical coupler 16 and potentiometer R3 to the other plate of capacitor C1. Also, a resistance R2 is connected directly in parallel with capacitor C1. Finally, photocell R7 of optical coupler 16 is connected in parallel with resistor R6 across which the gate voltage is developed. It will be recognized by those skilled in the art that photocell R7 of optical coupler 16 is normally characterized by a relatively high impedance which will not significantly load resistor R6. However, upon activation by light emitted from LED D7 the impedance of photocell R7 will drop to a relatively low level, thereby significantly reducing the voltage otherwise appearing across resistor R6.

During normal operation of the circuit shown in FIG. 3, positive alternations of the primary current will follow a path from terminal 13 through the primary winding L1 and the impedance z to the anode of diode D3. From diode D3 the current flows through the SCR and therefrom through diode D6 and back to terminal 14. During negative alternations of the A.C. input voltage, the current path is from terminal 14 through diode D4 to the anode of the SCR. From the SCR the current path continues through diode D5, impedance Z and the primary winding L1 to terminal 13. A small amount of the rectified current through the SCR flows through the voltage divider comprising resistors R4 and R6. Component values are chosen such that the voltage developed across resistor R6, and applied to the gate of the SCR through resistor R5, is normally sufficient to maintain the SCR conductive. Therefore, under normal operating conditions the SCR will remain conductive allowing the flow of primary current.

As previously explained, capacitor C1 will charge through diode D1 to a level corresponding to the current flowing through the primary winding. Since, under normal conditions, the voltage developed across capacitor C1 will be insufficient to initiate conduction of zener diode D2, LED D7 will normally remain off, causing the resistance of photocell R7 to remain relatively high so as to not substantially affect the gate voltage developed across resistor R6. In this manner, under normal operating conditions, primary current flow is maintained to allow energization of the precipitator.

However, in response to the development of an arcing condition in the precipitator, capacitor C1 will quickly charge to an increased level as a result of the high level transients reflected from the secondary winding L2 to the primary winding L1 of transformer T1. The increased voltage across capacitor C1 will cause zener diode D2 to break into conduction and activate LED D7. Activated LED D7 will couple light to photocell R7 causing its impedance to drop significantly. The decreased impedance of photocell R7 will cause the gate voltage across R6 to decrease thereby cutting off the SCR. The cut off SCR will prevent the flow of primary current, thereby removing power from the precipitator to suppress the arcing condition. In this regard, it will be recognized that sensitivity adjust potentionmeter R3 may be set to vary the conduction current through zener diode D2 and LED D7 to control the time required to cut off the SCR in response to an arcing condition in the precipitator.

After the SCR has been cut off, capacitor C1 begins to discharge primarily through resistance R2 and also sensitivity adjust potentiometer R3. When capacitor C1 has discharged to the level where zener diode D2 is no longer conductive, LED D7 will turn off increasing the impedance of photocell R7 to gate the SCR back on. The time required for capacitor C1 to discharge is primarily dependent on the resistance of resistor R2 which will normally be significantly less than the resistance of sensitivity adjust potentiometer R3. Theefore, as with the circuit of FIG. 2, power is removed from the precipitator in response to the development of an arcing condition. And, after the time required for capacitor C1 to discharge, power is automatically reapplied to the precipitator to re-establish normal operation. It will be appreciated that the foregoing operation is automatically repeated by the circuit each time an arcing condition is developed within the precipitator. In other words, the circuitry of the present invention automatically suppresses arcs developed within the precipitator and thereby protects both the precipitator and power supply from possibly extensive damage. And, the foregoing is accomplished without the necessity of manual supervision.

It will be noted that the capacitive charging and discharging network is electrically isolated from the SCR gate network by means of the optical coupler 16. This isolation allows the time constant associated with the capacitive network to be set independently of the setting of the voltage divider in the SCR gate network. independent adjustability of the networks is desirable and increases the overall attractiveness of the circuit.

The embodiment of the present invention shown in FIG. 4 is substantially identical to that previously described with regard to FIG. 3. The major modification comprises the substition of transformer T2, diode D8, capacitor C2 and resistor R8 as an alternate SCR gate network. Impedance Z presents a resistance or an inductive reactance, the latter being desirable when the entire circuit is modularized due to its tendency to minimize modular heating. As a result, increased useful life can be expected from the modularized circuit.

In the gate network of the SCR, the primary winding L5 of transformer T2 is connected across input terminals 13 and 14. The secondary winding L6 of transformer T2 feeds a filter network comprising rectifying diode D8 and filter capacitor C2. The output of the filter network is applied to a gate trim potentiometer R7 for application to the gate of the SCR.

This sliding contact of gate trim potentiometer R8 is adjusted so that, under normal operating conditions, the signal applied to the gate of the SCR is sufficient to maintain the SCR conductive. However, when photocell R7, which is connected in parallel with the sliding contact of gate trim potentiometer R8 and the cathode of the SCR, is activated by light emitted from LED D7 the voltage applied to the gate of the SCR will be decreased so as to render the SCR non-conductive. The remaining features and operation of the embodiment shown in FIG. 4 are identical to those previously described with regard to FIG. 3 and will therefore not be repeated.

A slight modification to the circuits of FIGS. 3 and 4 which has been found to be quite desirable is the connection of a thermistor R9 in parallel with sensitivity adjust potentiometer R3. Thermistor R9 compensates for circuit changes with temperature and helps to stabilize the operation of the circuits.

Although the invention has been shown and described in connection with certain specific embodiments, it will be readily apparent to those skilled in the art that various changes in form and arrangement of parts may be made to suit requirements without departing from the spirit and scope of the invention. With this in mind, the embodiments of the invention in which an exclusive property or privilege is claimed are defined as follows:

I claim:

1. A circuit for controlling the duty cycle of a power supply of the type having a transformer and means connecting the secondary of said transformer to a two-stage electrostatic precipitator, said duty cycle being controlled in response to high level transients generated by arcing between components of said precipitator and reflected from the secondary of said transformer to the primary thereof, said circuit comprising:

a. switch means connected in series with the primary of said transformer and being controllable for allowing and inhibiting current flow therethrough, said switch means comprising the combination of a bridge rectifier and an SCR interconnected for passing both alternations of an A.C. signal applied across the primary of said transformer through said SCR in the same direction, said SCR having in association therewith a network for developing, from said A.C. signal, a gate voltage for maintaining said SCR in a conductive state;

b. means in association with the primary of said transformer for developing an output signal reflecting the current through the primary of said transformer; and c. sensing and control means for operating said switch means to inhibit said current flow in response to the generation of said high level transients substantially until the arcing condition associated therewith is supressed and to otherwise allow said current flow, said sensing and control means including isolating means having a light emitting element for electrically isolating said sensing and control means from said switch means, the combination of a capacitor and means for charging said capacitor connected in parallel with said output signal developing means for charging said capacitor to a level reflecting the current through the primary of said transformer, said means for charging being connected to prevent discharging said capacitor through said output signal developing means and said SCR and through the primary of said transformer, and the series combination of threshold means, resistor means and said light emitting element connected in parallel with said capacitor, said threshold means conducting only when said output signal exceeds a preset level to operate said switch to inhibit said current flow, said output signal being reset to a level less than said preset level after an interval following said inhibiting of said current flow for resuming said current flow upon the termination of said interval.

2. The circuit according to claim 1 wherein said resistor means includes means for compensating said sensing and control means for changes in temperature.

* * * * *